US007018306B2

(12) United States Patent
Halko et al.

(10) Patent No.: US 7,018,306 B2
(45) Date of Patent: Mar. 28, 2006

(54) MULTI-LAYER, WOUND GOLF BALL

(75) Inventors: Roman D. Halko, Natick, MA (US); Brian R. Fletcher, New Bedford, MA (US)

(73) Assignee: Acushnet Company, Fairhaven, MA (US)

( * ) Notice: Subject to any disclaimer, the term of this patent is extended or adjusted under 35 U.S.C. 154(b) by 185 days.

(21) Appl. No.: 10/252,377

(22) Filed: Sep. 24, 2002

(65) Prior Publication Data

US 2003/0069083 A1 Apr. 10, 2003

Related U.S. Application Data

(63) Continuation of application No. 09/641,758, filed on Aug. 21, 2000, now Pat. No. 6,458,046.

(51) Int. Cl.
*A63B 37/04* (2006.01)
*A63B 37/06* (2006.01)

(52) U.S. Cl. ..... 473/361; 473/371

(58) Field of Classification Search ..... 473/351–378
See application file for complete search history.

(56) References Cited

U.S. PATENT DOCUMENTS

| | | | | |
|---|---|---|---|---|
| 3,147,324 A | | 9/1964 | Ward | |
| 3,989,568 A | | 11/1976 | Isaac | |
| 4,123,061 A | | 10/1978 | Dusbiber | |
| 4,783,078 A | | 11/1988 | Brown et al. | |
| 5,020,803 A | | 6/1991 | Gendreau et al. | |
| 5,334,673 A | | 8/1994 | Wu | |
| 5,484,870 A | * | 1/1996 | Wu | 528/28 |
| 5,674,137 A | | 10/1997 | Maruko et al. | 473/354 |
| 5,683,312 A | | 11/1997 | Boehm et al. | 473/354 |
| 5,688,191 A | | 11/1997 | Cavallaro et al. | 473/373 |
| 5,692,974 A | | 12/1997 | Wu et al. | 473/377 |
| 5,713,801 A | * | 2/1998 | Aoyama | 473/354 |
| 5,716,293 A | | 2/1998 | Yabuki et al. | 473/363 |
| 5,772,530 A | | 6/1998 | Kato | 473/363 |
| 5,779,562 A | | 7/1998 | Melvin et al. | 473/373 |
| 5,810,678 A | | 9/1998 | Cavallaro et al. | 473/373 |
| 5,816,937 A | | 10/1998 | Shimosaka et al. | 473/354 |

(Continued)

FOREIGN PATENT DOCUMENTS

GB 2337706 A 1/1999

(Continued)

OTHER PUBLICATIONS

"Purforma", Goodyear Chemical Newletter.*

*Primary Examiner*—Gregory Vidovich
*Assistant Examiner*—Alvin A. Hunter, Jr.
(74) *Attorney, Agent, or Firm*—Swidler Berlin LLP

(57) ABSTRACT

A multi-layer golf ball can be prepared, possessing the performance characteristics of both a solid ball and a wound ball, by selecting the content and thickness of one or more of the layers, wherein the multi-layer golf ball comprises a center, an intermediate layer, a wound layer of tensioned material, and a cover, such that any one or more of the following are satisfied: (a) at least a portion of the intermediate layer includes a thermoset material; (b) the winding includes fiber, glass, carbon, polyether urea, polyether block copolymers, polyester urea, polyester block copolymers, isotactic-poly(propylene), polyethylene, polyamide, poly (oxyethylene), polyketone, poly(ethylene terephthalate), poly(p-phenylene terephthalamide), poly(acrylonitrile), diaminodicyclohexyhnethane, dodecanedicarboxylic acid, or copolymers or combinations thereof; (c) the thickness of the wound layer is less than about 1 mm; and (d) at least a portion of the cover includes a thermoset material. Methods of preparation of such golf balls are also recited.

7 Claims, 1 Drawing Sheet

U.S. PATENT DOCUMENTS

| | | | | | |
|---|---|---|---|---|---|
| 5,816,940 | A | | 10/1998 | Hayashi et al. | 473/359 |
| 5,816,941 | A | | 10/1998 | Hayashi et al. | 473/359 |
| 5,816,942 | A | | 10/1998 | Hayashi et al. | 473/359 |
| 5,836,831 | A | | 11/1998 | Stanton et al. | 473/354 |
| 5,848,943 | A | * | 12/1998 | Sano et al. | 473/365 |
| 5,885,172 | A | | 3/1999 | Hebert et al. | 473/354 |
| 5,888,151 | A | | 3/1999 | Hayashi | 473/363 |
| 5,976,034 | A | | 11/1999 | Kato et al. | 473/363 |
| 6,056,650 | A | | 5/2000 | Yamagishi et al. | 473/384 |
| 6,149,535 | A | * | 11/2000 | Bissonnette et al. | 473/354 |
| 6,287,216 | B1 | | 9/2001 | Boehm | 473/354 |
| 6,458,046 | B1 | * | 10/2002 | Halko et al. | 473/361 |
| 6,475,417 | B1 | * | 11/2002 | Nesbitt et al. | 264/134 |
| 6,497,630 | B1 | * | 12/2002 | Hebert et al. | 473/357 |
| 6,500,076 | B1 | * | 12/2002 | Morgan et al. | 473/361 |
| 2001/0024979 | A1 | * | 9/2001 | Nesbitt et al. | 473/370 |

FOREIGN PATENT DOCUMENTS

| | | |
|---|---|---|
| WO | WO 98/37929 | 9/1998 |

* cited by examiner

MULTI-LAYER, WOUND GOLF BALL

CROSS-REFERENCE TO RELATED APPLICATIONS

This application is a Continuation of U.S. patent application Ser. No. 09/641,758 filed Aug. 21, 2000, now U.S. Pat. No. 6,458,046, which is incorporated herein by reference in its entirety.

FIELD OF THE INVENTION

The present invention is directed to a multi-layer, wound golf ball, especially one with the combined performance characteristics of both a wound and solid construction. In particular, the present invention relates to a golf ball with a wound thread layer disposed between the cover and a core, which comprises a center and an intermediate layer disposed about the center.

BACKGROUND OF THE INVENTION

Conventional golf balls can be divided into two general types or groups: solid balls and wound balls. The difference in play characteristics resulting from these different types of constructions can be quite significant.

Solid balls with a two-piece construction are generally most popular with the average recreational golfer, because they provide a very durable ball for a reasonable price while also providing maximum distance. Two piece solid balls are typically made with a single solid core, usually made of a crosslinked rubber, which is encased by a hard cover material. The combination of the core and cover materials, which are very rigid, provide a hard feel for the ball when it is struck with a club and provide a ball that is virtually indestructible by golfers. This combination of materials helps impart a high initial velocity to the ball, which results in improved distance. In addition, this combination provides balls having a relatively low spin rate, which tends to provide greater driver distance.

At the present time, however, the wound ball generally remains the preferred ball of more advanced players due to its spin and feel characteristics. Wound balls typically have either a solid rubber or fluid-filled center around which many yards of a tensioned elastic thread or yarn are wrapped to form a wound core. Typically, the tensioned elastic thread is made of synthetic polyisoprene or natural rubber. For example, U.S. Pat. Nos. 5,674,137; 5,716,293; 5,816,937; 5,816,940; 5,816,941; 5,816,942; 5,888,151; and 5,976,034 relate to multi-layer, wound golf balls containing rubber thread windings. The wound core is then typically covered with a durable cover material, such as a SURLYN® or a similar material, or a softer "performance" cover, such as balata or polyurethane.

Typically, a single strand of thread is employed in forming the wound core. This thread can be wrapped at variable tension as disclosed in U.S. Pat. No. 4,783,078. Some balls, however, have used two or more different threads of different dimensions to form the wound core. In this case, the innermost thread may be wound at a different tension and with a different pattern than the outermost thread. Furthermore, the outermost thread is generally wound in a more open pattern to form larger gaps between the thread, which helps ensure good amalgamation between the cover and the wound core.

The United States Golf Association (USGA) has instituted a rule that prohibits the competitive use in any USGA sanctioned event of a golf ball that can achieve greater than an initial velocity of 76.2 meters per second (m/s), or 250 ft/s, when tested in a standardized device operated by the USGA (referred to hereinafter as "the USGA test"). An allowed tolerance of 2 percent, however, permits manufacturers to produce golf balls that achieve an initial velocity of up to 77.7 m/s (255 ft/s).

Players generally seek a golf ball that delivers maximum distance off the tee, which requires a high initial velocity upon impact. Therefore, in an effort to meet the demands of the marketplace while providing conforming balls, manufacturers typically strive to produce golf balls with initial velocities no greater than that permitted by the USGA test. Manufacturers try to provide these balls with a range of different properties and characteristics, such as spin and compression, to enhance short iron shots, as well.

To meet the needs of golfers having varying levels of skill, golf ball manufacturers are also concerned with varying the compression of the ball, which is a measurement of the deformation of a golf ball under a load. A ball with a higher compression feels harder than a ball of lower compression. Wound golf balls generally have lower compression and spin characteristics that are preferred by better players. Whether wound or solid, all golf balls become generally more resilient (i.e., have higher initial velocities) as compression increases. Manufacturers of both wound and solid construction golf balls must balance the requirement of higher initial velocity from higher compression with the desire for a softer feel from lower compression.

Wound balls typically enable a skilled golfer to have more control over the ball's flight and final position using short-iron shots than many non-wound balls. Particularly with approach shots into the green, the typically higher spin rate of soft covered, wound balls enables many golfers to stop the ball very near its landing position. Soft covered wound balls with their lower compression, however, tend to exhibit a lower initial velocity than hard covered solid balls. This characteristic, in combination with a higher spin rate than solid balls, means wound balls generally display shorter distance than hard covered solid balls when struck with a driver. The advantages of wound constructions over solid ones, however, are more related to spin and controllability than distance.

A softer feel is the result of a lower compression, but feel is also affected by cover hardness and thickness. In wound constructions, a thinner cover will have a softer feel, so manufacturers often strive to produce balls with the thinnest possible covers. The packing density of the windings and the cover formulation process can affect the thickness of the cover, but other factors related to the cover will also affect this thickness.

It is known in the art to modify conventional solid balls by altering the typical single layer core and single cover layer construction to provide a multi-layer ball having such as a dual cover layer and/or a ball having a mantle layer disposed between the cover and the core. Like the solid cores, various cover layers and mantle layers are typically formed of polybutadiene that is chemically crosslinked with zinc diaerylate and/or similar crosslinking agents. The playing characteristics of multi-layer balls, for example compression, can be tailored by varying the properties of one or more of these mantle layers, also known as intermediate layers.

A number of patents are directed towards modifying the properties of layers used in forming conventional solid balls, multi-layer balls having two or more cover layers, dual core layers, such as those having a mantle layer disposed between the cover and center, and/or wound balls. For example, U.S. Pat. Nos. 5,674,137; 5,816,937; 5,816,942; and 5,885,172 are directed to multi-layer wound golf balls having multi-layer covers. For example, U.S. Pat. Nos. 3,147,324; 5,816,937; and 5,885,172 are directed to golf balls, or methods for making such, having a polyurethane outer cover. For example, U.S. Pat. Nos. 5,716,293 and 5,020,803 are directed to wound golf balls having a dual layer liquid core.

U.S. Pat. No. 5,020,803 to Gendreau et al. discloses a golf ball containing a liquid-filled center, surrounded by a heavy-walled sphere, around which a wound layer is disposed to form a wound core. The heavy-walled sphere is preferably rubber and is between 0.16 and 0.64 cm thick.

British Patent No. GB 2337706 A to Sumitomo Rubber Industries, Ltd. discloses a multilayer wound golf ball having a dual layer center, both layer being formed from the same materials. The diameter of both center layers are limited, as are the 3IS-C hardnesses, and cover is made from a thermoplastic material.

Polyurethane is the product of a reaction between a polyurethane prepolymer and a curing agent. The polyurethane prepolymer is a product formed by a reaction between a polyol and a diisocyanate. The curing agents used previously are typically diamines or glycols. A catalyst is often employed to promote the reaction between the curing agent and the polyurethane prepolymer.

Polyurethanes are typically divided into two categories: thermosets and thermoplastics. Thermoplastic polyurethanes are typically formed by the reaction of a diisocyanate, such as 4,4'-diphenylmethane diisocyanate ("MDI") or 3,3'-dimethyl-4,4'-biphenylene diisocyanate ("TODI"), and a polyol cured with a diol, such as 1,4-butanediol. Thermoset polyurethanes are typically formed by the reaction of a diisocyanate, such as 2,4-toluene diisocyanate ("TDI") or methylene-bis-(4-cyclohexyl isocyanate) ("HMDI"), and a polyol which is cured with a polyamine, a triol such as trimethylol propane, or a tetrafunctional glycol, such as N,N,N',N'tetra-bis-(2-hydroxypropyl) ethylenediamine.

U.S. Pat. No. 4,123,061 teaches a golf ball made from a polyurethane prepolymer of polyether and a curing agent, such as a trifunctional polyol, a tetrafunctional polyol, or a diamine. U.S. Pat. No. 5,334,673 discloses the use of two categories of polyurethane available on the market, i.e., thermoset and thermoplastic polyurethanes, for forming golf ball covers and, in particular, thermoset polyurethane covered golf balls made from a composition of polyurethane prepolymer and a slow-reacting amine curing agent and/or a difunctional glycol.

Unlike SURLYN® ionomer covered golf balls, polyurethane golf ball covers can be formulated to possess a softer "feel" like balata covered golf balls. However, golf ball covers made from polyurethane have not, to date, fully matched SURLYN® golf balls with respect to resilience or the rebound of a balata golf ball cover, which is a function of the initial velocity of a golf ball after impact with a golf club.

U.S. Pat. No. 3,989,568 discloses a three-component system employing either one or two polyurethane prepolymers and one or two polyol or fast-reacting diamine curing agents. The reactants chosen for the system must have different rates of reactions within two or more competing reactions.

U.S. Pat. No. 4,123,061 discloses a golf ball made from a polyurethane prepolymer of polyether and a curing agent, such as a trifunctional polyol, a tetrafunctional polyol, or a fast-reacting diamine curing agent.

U.S. Pat. No. 5,334,673 discloses a golf ball cover made from a composition of a thermosetting polyurethane prepolymer and a slow-reacting polyamine curing agent and/or a difunctional glycol. Resultant golf balls are found to have improved shear resistance and cut resistance compared to covers made from balata or SURLYN®. U.S. Pat. No. 5,692,974 discloses methods of using cationic ionomers in golf ball cover compositions. Additionally, the patent relates to golf balls having covers and cores incorporating urethane ionomers. Improved resiliency and initial velocity are achieved by the addition of an alkylating agent, such as t-butyl-chloride, which induces ionic interactions in the polyurethane to produce cationic type ionomers.

PCT Publication WO 98/37929 discloses a composition for golf ball covers that includes a blend of a diisocyanate/polyol prepolymer and a curing agent comprising a blend of a slow-reacting diamine and a fast-reacting diamine. Improved "feel," playability, and durability characteristics are exhibited.

U.S. Pat. No. 5,976,034 discloses a composition for a multi-layer, wound golf ball that have a solid center and a thermoplastic intermediate layer that form a dual layer core, rubber thread windings, and a thermoplastic cover. These golf balls are said to possess high initial velocity at low head speed region and excellent flight performance, without compromising shot "feel."

U.S. Pat. No. 6,056,650 discloses a multi-piece golf ball having a solid core and a multi-layer cover having at least three layers, where the innermost cover layer and the outermost cover layer differ in hardness by not more than 3 Shore D units. These golf balls are said to possess increased flight distance when hit over a broad range of head speeds with any type of club, while maintaining feel, control, and durability.

Golf ball manufacturers are continually searching for new ways in which to provide wound golf balls that deliver the maximum performance for golfers. It would be advantageous to provide such a wound golf ball having improved playing characteristics.

SUMMARY OF THE INVENTION

The present invention is directed to a wound golf ball having at least four layers and a construction that can be tailored to possess the desired mix of characteristics of solid and wound golf balls. The performance of such a golf ball can be improved by altering the composition and/or nature of the materials and construction of the golf ball, as described below.

The present invention further relates to a multi-layer, wound golf ball comprising a center, at least one intermediate layer disposed over the center, a wound layer of a tensioned thread material disposed over the at least one intermediate layer, and a cover disposed over the wound layer, wherein at least one of the cover or the at least one intermediate layer may include a component that contains a thermoset material. In one embodiment, the center is solid, while in another embodiment the center is fluid-filled. Preferably, when the component includes a thermoset material and is present in the at least one intermediate layer or in the cover, the Shore D hardness of such layer is typically from about 30 to 85, more preferably from about 40 to 75, most preferably from about 50 to 65. In one embodiment, the difference in Shore D hardness between the outermost of the intermediate layers and the outermost cover layer may advantageously be less than about 10, preferably less than about 5, more preferably less than about 3.

Advantageously, the golf ball may include a cover having at least one of a dimple coverage of greater than about 60 percent, a hardness from about 30 to 85 Shore D, or a flexural modulus of greater than about 500 psi (3.4 MPa), and the golf ball has at least one of a compression from about 50 to 120 or a coefficient of restitution of greater than about 0.7.

The center of the golf ball may advantageously include one or more layers of polybutadiene, natural rubber, polyisoprene, styrene-butadiene copolymers, styrene propylene-diene copolymers, or copolymers or mixtures thereof. Preferably, the diameter of the center can measure at least about 1 inch (25 mm), more preferably from about 0.9 inches (23 mm) to 1.5 inches (38 mm).

Additionally, the tensioned thread material of the wound layer may include fiber, glass, carbon, polyether urea, polyether block copolymers, polyester urea, polyester block copolymers, isotactic-poly(propylene), polyethylene, polyamide, poly(oxymethylene), polyketone, poly(ethylene terephthalate), polyp-phenylene terephthalamide), poly (acrylomtrile), diaminodicyclohexylmethane, dodecanedicarboxylic acid, natural rubber, polyisoprene rubber, styrene-butadiene copolymers, styrene-propylene diene copolymers, another synthetic rubber, or block, graft, random, alternating, brush, multi-arm star, branched, or dendritic copolymers, or combinations thereof. It should be understood that "combinations" of materials can include copolymers of those materials, as well as mere mechanical mixtures.

In one preferred embodiment, the thread material may include polyether urea, natural rubber, cis-polyisoprene, or mixtures thereof. In one more preferred embodiment, the thread material can include a polyether urea. Alternately, the thread material can include a blend of synthetic rubber and natural rubber. In the latter case, the synthetic rubber can include a mixture of at least two cis-1,4-polyisoprenes. Preferably, the synthetic polyisoprenes and the natural rubber in this embodiment may be present in amounts of at least about 60% and less than 40%, respectively, but more preferably, the synthetic polyisoprenes have a cis-1,4 content of at least 90%. It can be advantageous for the wound layer thickness to be less than 1 mm, especially where the thread material includes polyether urea. In other embodiments, the wound layer thickness may be less than 8 mm, preferably from about 0.9 mm to 8 mm.

In one preferred embodiment, the component includes at least two thermoset materials. In another preferred embodiment, the component includes at least one thermoset material and is substantially free of thermoplastic material, preferably entirely free of thermoplastic material.

Additionally, it is preferable that the at least one intermediate layer include a thermoset material, while the cover includes a thermoplastic material. Alternately, it is preferable that the cover include a thermoset material, while the at least one intermediate layer includes a thermoplastic material.

In another preferred embodiment, both the at least one intermediate layer and the cover each include a thermoset material, preferably the same thermoset material. Preferably, the cover contains a single layer.

Another aspect of the present invention relates to a multi-layer, wound golf ball comprising a center, at least one intermediate layer disposed over the center, a wound layer of a tensioned thread material disposed over the at least one intermediate layer, and a cover disposed over the wound layer, wherein the tensioned thread material can include fiber, glass, carbon, polyether urea, polyether block copolymers, polyester urea, polyester block copolymers, isotactic-poly(propylene), polyethylene, polyamide, poly(oxymethylene), polyketone, poly(ethylene terephthalate), poly(p-phenylene terephthalamide), poly(acrylonitrile), diaminodicyclohexylmethane, dodecanedicarboxylic acid, or block, graft, random, alternating, brush, multi-arm star, branched, or dendritic copolymers or mixtures thereof. Preferably, the thread material may include polyether urea. In other preferred embodiments, the wound layer thickness can be less than about 8 mm, preferably from about 0.9 mm to 8 mm. It can be advantageous for the wound layer thickness to be less than 1 mm, especially where the thread material includes polyether urea.

Advantageously, at least one of the cover or the at least one intermediate layer may include a component that contains a thermoset material.

The present invention also relates to a multi-layer, wound golf ball comprising a center, at least one intermediate layer disposed over the center, a wound layer of a tensioned thread material disposed over the at least one intermediate layer and having a thickness of less than about 1 mm, and a cover disposed over the wound layer.

In one embodiment, the tensioned thread material includes fiber, glass, carbon, polyether urea, polyether block copolymers, polyester urea, polyester block copolymers, isotactic-poly(propylene), polyethylene, polyamide, poly (oxymethylene), polyketone, poly(ethylene terephthalate), poly(p-phenylene terephthalamide), poly(acrylonitrile), diaminodicyclohexylmethane, dodecanedicarboxylic acid, natural rubber, polyisoprene rubber, styrene-butadiene copolymers, styrene-propylene-diene copolymers, another synthetic rubber, or block, graft, random, alternating, brush, multi-arm star, branched, or dendritic copolymers, or combinations thereof.

Further preferred embodiments may include, but are not limited to, any combination or permutation of aspects or qualities of the present invention listed above.

BRIEF DESCRIPTION OF THE DRAWINGS

Further features and advantages of the invention can be ascertained from the following detailed description that is provided in connection with the drawings described below.

DEFINITIONS

Figure 1:
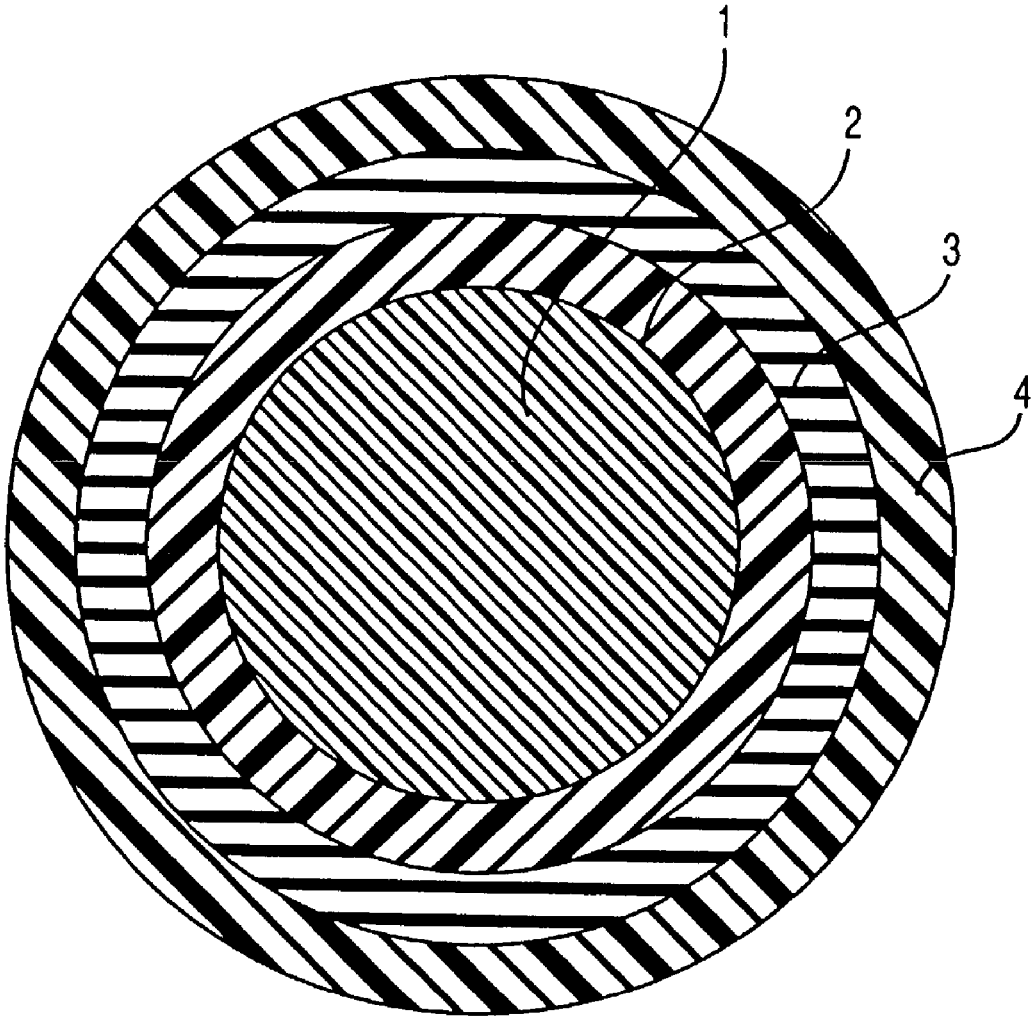
FIG. 1 is a cross-section of a golf ball having a cover, and having an intermediate layer between a wound layer and a center, according to the invention.

The term "about," as used herein, should be understood to refer to both numbers in a range of numbers.

As used herein, the term "Atti compression" is defined as the deflection of an object or material relative to the deflection of a calibrated spring, as measured with an Atti Compression Gauge, that is commercially available from Atti Engineering Corp. of Union City, N.J. Atti compression is typically used to measure the compression of a golf ball. When the Atti Gauge is used to measure cores having a diameter of less than 1.68 inches (43 mm), it should be understood that a metallic or other suitable shim is used to make the measured object approximately 1.68 inches (43 mm) in diameter.

As used herein, the term "coefficient of restitution" ("CoR") for golf balls is defined as the ratio of the rebound velocity to the inbound velocity when balls are fired into a rigid plate. The inbound velocity is understood to be 125 ft/s (38.1 m/s).

As used herein, the term "substantially free" means less than about 5 weight percent, preferably less than about 3 weight percent, more preferably less than about I weight percent, and most preferably less than about 0.01 weight percent.

The term "fluid," as used herein, includes gases, liquids, pastes, gels, or any combination thereof. Useful gases are typically minimally reactive and may preferably include nitrogen or air. It should also be understood that, as used herein, a fluid-filled component may also be hollow or contain at least a partial vacuum.

As used herein, the terms "polymer" and "polymeric material" include amorphous, semi-crystalline, or crystalline polymers, and mixtures thereof, including, for example, random and block copolymers, rubbers, thermosets, thermoplastics, thermoplastic elastomers, and the like.

As used herein, the term "copolymer" should be understood to mean any block, graft, random, alternating, brush, multi-arm star, branched, dendritic, or other type of copolymer having two or more repeating units that is available to one of ordinary skill in the art.

DETAILED DESCRIPTION OF THE PREFERRED EMBODIMENTS

The present invention is directed to a wound golf ball having at least four layers, where at least one wound layer is disposed over at least one intermediate layer, which is disposed over a center. A cover is then disposed over the wound layer. In one embodiment, at least one of the at least one intermediate layer and the cover includes a thermoset material. In a preferred embodiment, the at least one intermediate layer includes at least one thermoset material. In another preferred embodiment, the cover includes at least one thermoset material. In yet another preferred embodiment, the at least one intermediate layer and the cover each include at least one thermoset material. This at least one thermoset material can be the same thermoset material or a different material for each layer.

The golf ball according to the invention includes a center about which at least one intermediate layer is disposed. The center may be fluid or solid, but is preferably solid. In either case, the center is prepared using any material available to those of ordinary skill in the art, for example, such as a mixture of base rubber, a crosslinking agent, and optionally a free-radical initiator and/or filler(s). Examples of solid center materials include solid rubber, solid thermoplastic material, cork, wood, metal, or any combination thereof. Suitable fluid components in this embodiment may include, but are not limited to: air, water, corn syrup solids, salts, sugars and sugar derivatives, polymers and copolymers, and other water activity reducing agents. Typically, fluid-filled centers include at least one of the listed components, are hollow, or contain at least a partial vacuum.

Center layers of golf balls formed according to the invention are typically made from one or more elastomeric materials, as noted above. The base rubber can typically include natural or synthetic rubbers. A preferred base rubber is 1,4-polybutadiene. Natural rubber, polyisoprene rubber and/or styrene-butadiene rubber may be optionally combined with the 1,4-polybutadiene. Alternatively, the center can be made of multiple layers.

A representative base composition for forming the solid golf ball center 1, which includes at least one layer, formed of at least polybutadiene and, in parts by weight based on 100 parts polybutadiene, 0–50 parts of a metal salt diacrylate, dimethacrylate, or monomethacrylate, preferably zinc diacrylate, 0.01 to 5 parts by weight of an organic peroxide, and optionally 0 to 50 parts by weight of a filler. Suitable commercial sources of polybutadiene include Cariflex BR1220 manufactured by Shell Chemical of Houston, Tex., Neocis BR40 manufactured by Enichem Elastomers of Houston, Tex., and Ubepol BR150 manufactured by Ube Industries, Ltd. of Ube, Japan.

The at least one intermediate layer of the present invention can include any suitable materials known to those of ordinary skill in the art, including one or more thermoplastic and/or thermosetting materials. Advantageously, the at least one intermediate layer can include thermosetting polyurethanes or thermoplastic ionic copolymers, such as ionic copolymers of ethylene and an unsaturated monocarboxylic acid, commercially available under the SURLYN family of materials from E.I. DuPont de Nemours & Co., of Wilmington, Del., or IOTEK or ESCOR of Exxon of Irving, Tex. These are copolymers of ethylene and methacrylic acid or acrylic acid partially neutralized with salts of zinc, sodium, lithium, magnesium, potassium, calcium, manganese, nickel, or the like, or blends thereof, in which the salts are the reaction product of an olefin having from 2 to 8 carbon atoms and an unsaturated monocarboxylic acid having 3 to 8 carbon atoms. The carboxylic acid groups of the copolymer may be totally or partially neutralized and might include, for example, methacrylic, crotonic, maleic, fumaric or itaconic acid. However, any neutralized copolymer may be used in the golf balls of the present invention. In one preferred embodiment, the at least one intermediate layer and the center comprise different materials.

The golf balls of the present invention can likewise include one or more homopolymenc or copolymeric thermoplastic or thermoset materials in the at least one intermediate layer. One of ordinary skill in the art would know that most of the polymeric materials listed below may belong in the thermoplastic category or in the thermoset category, depending upon the nature of the repeat units, functional groups pendant from the repeat units, method of polymerization, method of formation, temperature of formation, post-polymerization treatments, and/or many other possible factors. The materials include, but are not limited to, the following:

(1) Vinyl resins, for example, such as those formed by the polymerization of vinyl chloride, or by the copolymerization of vinyl chloride with vinyl acetate, acrylic esters or vinylidene chloride;

(2) Polyolefins, for example, such as polyethylene, polypropylene, polybutylene, and copolymers, such as ethylene methylacrylate, ethylene ethylacrylate, ethylene vinyl acetate, ethylene methacrylic acid, ethylene acrylic acid, or propylene acrylic acid, as well as copolymers and homopolymers produced using a single-site catalyst;

(3) Polyurethanes, for example, such as those prepared from diols, triols, or polyols and diisocyanates, triisocyanates, or polyisocyanates, as well as those disclosed in U.S. Pat. No. 5,334,673;

(4) Polyureas, for example, such as those prepared from diamines, triamines, or polyamines and diisocyanates, triisocyanates, or polyisocyanates, as well as those disclosed in U.S. Pat. No. 5,484,870;

(5) Polyamides, for example, such as poly(hexamethylene adipamide) and others prepared from diamines and dibasic acids, as well as those from amino acids such as poly (caprolactam), and blends of polyamides with SURLYN, polyethylene, ethylene copolymers, ethyl-propylene-non-conjugated diene terpolymer, and the like;

(6) Acrylic resins and blends of these resins with, for example, polymers such as poly vinyl chloride, elastomers, and the like;

(7) Olefinic rubbers, for example, such as blends of polyolefins with ethylene-propylene-non-conjugated diene terpolymer; block copolymers of styrene and butadiene, isoprene or ethylene-butylene rubber; or copoly(ether-amide), such as PEBAX, sold by ELF Atochem of Philadelphia, Pa.;

(8) Polyphenylene oxide resins or blends of polyphenylene oxide with high impact polystyrene, for example, as sold under the trademark NORYL by General Electric Company of Pittsfield, Mass.;

(9) Polyesters, for example, such as polyethylene terephthalate, polybutylene terephthalate, polyethylene terephthalate/glycol modified and elastomers, such as sold under the trademarks HYTREL by E.I. DuPont de Nemours & Co. of Wilmington, Del., and LOMOD by General Electric Company of Pittsfield, Mass.;

(10) Blends and alloys, for example including polycarbonate with acrylonitrile butadiene styrene, polybutylene terephthalate, polyethylene terephthalate, styrene malefic anhydride, polyethylene, elastomers, and the like, and polyvinyl chloride with acrylonitrile butadiene styrene, ethylene vinyl acetate, or other elastomers;

(11) Blends of vulcanized, unvulcanized, or non-vulcanizable rubbers with polyethylene, propylene, polyacetal, nylon, polyesters, cellulose esters, and the like; and

(12) Polymers or copolymers possessing epoxy-containing, or post polymerization epoxy-functionalized, repeat units, for example, in combination with anhydride, ester, amide, imide, carbonate, ether, urethane, urea, olefin, conjugated, or acid (optionally totally or partially neutralized with inorganic salts) comonomers, or copolymers or blends thereof.

The at least one intermediate layer may also contain polymers such as ethylene, propylene, and other 1-atkylene based homopolymers and copolymers, including functional monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly (phenylene sulfide), acrylonitrile-butadiene, acrylic-styrene-acrylonitrile, poly(ethylene terephthalate), poly(butylene terephthalate), poly(ethylene vinyl alcohol), poly(tetrafluoroethylene) and their copolymers including functional comonomers and blends thereof. One exemplary material for use in the at least one intermediate layer, preferably in blends with ionomer(s), such as SURLYN®, is a non-ionomer(c, maleic anhydride-grafted, ethylene-butylene metallocene-catalyzed polymer. This material has been commercially available, for example, under the name FUSABOND 525D or SURLYN® NMO 525D, from E.I. DuPont de Nemours & Co. of Wilmington, Del. The at least one intermediate layer may further include a polyether or polyester thermoplastic urethane, a thermoset polyurethane, or an ionomer, for example, such as acid-containing ethylene copolymer ionomers, including E/X/Y terpolymers where E is ethylene, X is an acrylate- or methacrylate-based comonomer present in 0 to 50 weight percent and Y is acrylic or methacrylic acid present in 5 to 35 weight percent.

In those embodiments wherein the at least one intermediate layer of the golf ball is formed with a thermoset material, for example, such as a polyurethane, the layer may be molded onto the unfinished ball in accordance with the teaching of U.S. Pat. Nos. 5,733,428 and 5,888,437, without, of course, the step(s) associated with forming dimples. Preferably, the at least one intermediate layer can include thermosetting polyurethanes.

In one preferred embodiment, when the component present in at least one of the at least one intermediate layer or the cover includes a thermoset material, the thermoset material may be present in an amount greater than about 10 weight percent of the total polymer in the given layer, preferably in an amount greater than about 50 weight percent, more preferably in an amount greater than about 90 weight percent, most preferably in an amount such that the given layer is substantially free of thermoplastic polymer material.

In another embodiment, the at least one intermediate layer can possess a Shore D hardness from about 30 to 52, preferably from about 35 to 50, as measured on the unfinished ball after disposition of the at least one intermediate layer. In yet another embodiment, the thickness of the at least one intermediate layer can be greater than about 0.65 cm.

The wound layer is typically disposed about the at least one intermediate layer and includes a tensioned thread material. Many different kinds of thread materials may be used for the wound layer of the present invention. The thread may be single-ply or may include two or more plies. Preferably, the thread of the present invention is single-ply. The thread may be selected to have varied material properties, dimensions, cross-sectional shapes, and methods of manufacturing. If two or more threads are used, they may be identical in material and mechanical properties or they may be substantially different from each other, either in cross-section shape or size, composition, elongated state, and mechanical or thermal properties. Mechanical properties that may be varied include, but are not limited to, resiliency, elastic modulus, and density. Thermal properties that may be varied include, but are not limited to, melt temperature, glass transition temperature, and thermal expansion coefficient.

The tensioned thread material of the wound layer typically includes fiber, glass, carbon, polyether urea, polyether block copolymers, polyester urea, polyester block copolymers, isotactic-poly(propylene), polyethylene, polyamide, poly(oxymethylene), polyketone, poly(ethylene terephthalate), poly(p-phenylene terephthalamide), poly(acrylonitrile), diaminodicyclohexylmethane, dodecanedicarboxylie acid, natural rubber, polyisoprene rubber, styrene-butadiene copolymers, styrene-propylene-diene copolymers, another synthetic rubber, or block, graft, random, alternating, brush, multi-arm star, branched, or dendritic copolymers, or mixtures thereof. For example, the tensioned thread material of the wound layer may include a polymeric material such as Hytrel©, a polyetherester commercially available from E.I. DuPont de Nemours of Wilmington, Del. Preferred thread materials are elastomeric, while graphite thread tends to be less preferred than other available thread types due to the difficulty in placing such threads under tension when being wound about a center. A preferred thread material includes polyether urea. Preferably, in one embodiment, the wound layer can be substantially free of polyisoprene, natural rubber, and/or other rubbers. More preferably, the wound layer is entirely free of polyisoprene and/or natural rubber. Another exemplary thread material is a mixture of cis-polyisoprene and natural rubbers, preferably at least about 60% of a blend of two or more synthetic cis-1,4 polyisoprene rubbers, and about less than 40% of a natural rubber component. It is preferred that the synthetic cis-1,4 polyisoprene rubbers have a cis-isomer content of at least 90%, however the cis-isomer content may vary for each rubber.

The thickness of the wound layer will typically be not more than about 8 mm, preferably from about 0.9 mm to 8 nun thick. More preferably, the thickness of the wound layer is less than 1 mm.

Threads used in the present invention may be formed using a variety of processes including conventional calendering and slitting, melt spinning, wet spinning, dry spinning and polymerization spinning. Any process available to one of ordinary skill in the art may be employed to produce thread materials for use in the wound layer. The tension used in winding the thread material of the wound layer may be selected as desired to provide beneficial playing characteristics to the final golf ball. The winding tension and elongation may be kept the same or may be varied throughout the layer. Preferably, the winding occurs at a consistent level of tension so that the wound layer has consistent tension throughout the layer.

In addition, the winding patterns used for the wound layer can be varied in any way available to those of ordinary skill in the art. Although one or more threads may be combined to begin forming the wound layer, it is preferred to use only a single continuous thread.

The cover provides the interface between the ball and a club. Properties that are desirable for the cover include good moldability, high abrasion resistance, high tear strength, high resilience, and good mold release, among others. The cover typically provides good performance characteristics and durability. The cover of the golf ball typically has a thickness of at least about 0.075 cm. In one embodiment, the cover has a thickness from at least about 0.075 cm to 0.36 cm.

The cover of the present invention can include any suitable materials described above for the at least one intermediate layer. In those embodiments wherein the cover of the golf ball includes a thermoset material, for example, such as a polyurethane, the layer may be molded onto the unfinished ball in accordance with the teaching of U.S. Pat. Nos. 5,733,428 and 5,888,437, with, or optionally without, the step(s) associated with forming dimples. Preferably, the cover can include thermosetting polyurethanes.

In another embodiment, the cover can possess a Shore D hardness from about 30 to 52, preferably from about 35 to 50, as measured on the ball after disposition of the cover. In one preferred embodiment, the cover is a single layer.

To clarify the scope of the invention, a golf ball made according to the invention has at least four layers including a center, at least one intermediate layer, a wound layer, and a cover. From this basic construct, there are three major aspects of the present invention: (1) at least one of the at least one intermediate layer and the cover includes a component containing a thermoset material; (2) the wound layer contains a tensioned thread material that includes fiber, glass, carbon, polyether urea, polyether block copolymers, polyester urea, polyester block copolymers, isotactic-poly (propylene), polyethylene, polyamide, poly(oxymethylene), polyketone, poly(ethylene terephthalate), poly(p-phenylene terephthalamide), poly(acrylonitrile), diaminodicyclohexylmethane, dodecanedicarboxylic acid, or combinations thereof; and (3) the wound layer has a thickness less than 1 mm.

The first aspect of the invention can be broken down into three major categories of golf balls, having: (a) thermoplastic material in the at least one intermediate layer with thermoset material in the cover; (b) thermoset material in the at least one intermediate layer with thermoplastic material in the cover; and (c) thermoset material in both the at least one intermediate layer and the cover. The center of these golf balls may embody various constructions, as may the tensioned thread winding in the wound layer.

The second aspect of the invention specifies certain types of materials as the tensioned thread material of the wound layer. The center of these golf balls can embody various constructions. Also, although the at least one intermediate layer and the cover layer can embody various constructions, the second aspect of the invention may incorporate the three major categories of the first aspect of the invention, as well as the case where both the at least one intermediate layer and the cover contain only thermoplastic material.

The third aspect of the invention specifies a certain thickness of the wound layer. The center of these golf balls may embody various constructions. Also, although the tensioned thread material can embody various constructions, the third aspect of the invention may incorporate the winding materials specified in the second aspect of the invention, as well as including other materials, such as synthetic polyisoprene and/or natural rubber. Additionally, although the at least one intermediate layer and the cover layer can embody various constructions, the third aspect of the invention may incorporate the three major categories of the first aspect of the invention, as well as the case where both the at least one intermediate layer and the cover contain only thermoplastic material.

A free-radical source, often alternatively referred to as a free-radical initiator, may optionally be used in one or more layers of the golf balls according to the invention, particularly when the polymer component includes a thermoset material. The free-radical source is typically a peroxide, and preferably an organic peroxide. Suitable free-radical sources include di-t-amyl peroxide, di(2-t-butyl-peroxyisopropyl) benzene peroxide, 1,1-bis(t-butylperoxy)-3,3,5-trimethylcyclohexane, dicumyl peroxide, di-t-butyl peroxide, 2,5-di-(t-butylperoxy)-2,5-dimethyl hexane, n-butyl-4,4-bis(t-butylperoxy)valerate, lauryl peroxide, benzoyl peroxide, t-butyl hydroperoxide, and the like, and any mixture thereof. The peroxide is typically present in an amount greater than about 0.1 parts per hundred of the total polymer component, preferably about 0.1 to 15 parts per hundred of the polymer component, and more preferably about 0.2 to 5 parts per hundred of the total polymer component. It should be understood by those of ordinary skill in the art that the presence of certain components may require a larger amount of free-radical source than the amounts described herein. The free radical source may alternatively or additionally be one or more of an electron beam, UV or gamma radiation, x-rays, or any other high energy radiation source capable of generating free radicals. It should be further understood that heat often facilitates initiation of the generation of free radicals when peroxides are used as a free-radical initiator.

Crosslinking agents may also optionally be included in one or more layers of the golf ball according to the invention. Again, these are optional but preferred, particularly when the polymer component of a layer includes at least one thermoset material. Suitable crosslinking agents can include one or more metallic salts of unsaturated fatty acids or monocarboxylic acids, such as zinc, calcium, or magnesium acrylate salts, and the like, and mixtures thereof. Preferred acrylates include zinc acrylate, zinc diacrylate, zinc methacrylate, and zinc dimethacrylate, and mixtures thereof. The crosslinking agent, when included, should be present in an amount sufficient to crosslink a portion of the chains of polymers in the polymer component. For example, the desired compression may be obtained by adjusting the amount of crosslinking. This may be achieved, for example, by altering the type and amount of crosslinking agent, a method well-known to those of ordinary skill in the art. The crosslinking agent, when used is typically present in an amount greater than about 0.1 weight percent of the polymer component, preferably from about 10 to 40 weight percent of the polymer component, more preferably from about 10 to 30 weight percent of the polymer component.

Fillers added to one or more layers of the golf ball typically include processing aids or compounds to affect Theological and mixing properties, the specific gravity (i.e., density-modifying fillers), the modulus, the tear strength, reinforcement, and the like. A density adjusting filler may be used to control the moment of inertia, and thus the initial spin rate of the ball and spin decay. For example, fillers maybe present in an amount from about 0.1 to 50 weight percent of a given layer.

Fillers are typically polymeric or inorganic in nature, and, when used, are typically present in an amount from about 0.1 to 50 weight percent of the layer in which they are included. Any suitable filler available to one of ordinary skill in the art may be used. Exemplary fillers include, but are not limited to, precipitated hydrated silica; clay; talc; asbestos; glass fibers; aramid fibers; mica; calcium metasilicate; barium sulfate; zinc sulfide; lithopone; silicates; silicon carbide; diatomaceous earth; polyvinyl chloride; carbonates such as calcium carbonate and magnesium carbonate; metals such as titanium, tungsten, aluminum, bismuth, nickel, molybdenum, iron, lead, copper, boron, cobalt, beryllium, zinc, and tin; metal alloys such as steel, brass, bronze, boron carbide whiskers, and tungsten carbide whiskers; metal oxides such as zinc oxide, iron oxide, aluminum oxide, titanium oxide, magnesium oxide, tungsten oxide, lead oxides, and zirconium oxide; particulate carbonaceous materials such as graphite, carbon black, cotton flock, natural bitumen, cellulose flock, and leather fiber; micro balloons such as glass and ceramic; fly ash; cured, ground rubber; or combinations thereof.

Fillers may also include various foaming agents or blowing agents which may be readily selected by one of ordinary skill in the art. Foamed polymer blends may be formed by blending ceramic or glass microspheres with polymer material. Polymeric, ceramic, metal, and glass microspheres may be solid or hollow, and filled or unfilled.

Fillers are typically also added to one or more portions of the golf ball to modify the density thereof to conform to uniform golf ball standards. Fillers may also be used to modify the weight of the center or at least one additional layer for specialty balls, e.g., a lower weight ball is preferred for a player having a low swing speed.

Additionally, certain polymeric materials, such as unvulcanized polybutadiene rubber, in one or more layers of the golf balls prepared according to the invention typically have a Mooney viscosity greater than about 20, preferably greater than about 30, and more preferably greater than about 40. Mooney viscosity is typically measured according to ASTM D-1646.

The resultant golf balls prepared according to the invention typically will have dimple coverage greater than about 60 percent, preferably greater than about 65 percent, and more preferably greater than about 70 percent. The golf balls typically have a coefficient of restitution of greater than about 0.7, preferably greater than about 0.75, and more preferably greater than about 0.78. The golf balls also typically have an Atti compression of at least about 40, preferably from about 50 to 120, and more preferably from about 60 to 100. The golf ball polybutadiene material of the present invention typically has a flexural modulus of from about 500 psi (3.4 MPa) to 300,000 psi (2.1 GPa), preferably from about 2000 psi (13.7 MPa) to 200,000 psi (1.4 GPa). The golf ball polybutadiene material typically has a hardness of at least about 15 Shore A, preferably between about 30 Shore A and 80 Shore D, more preferably between about 50 Shore A and 60 Shore D. The specific gravity is typically greater than about 0.7, preferably greater than about 1, for the golf ball polybutadiene material.

Any size golf ball may be formed according to the invention, although the golf ball preferably meets USGA standards of size and weight. For example, the final golf ball should typically have an outer diameter of greater than about 1.67 inches (42 mm), preferably from about 1.67 inches (42 mm) to 1.74 inches (44 mm), more preferably of about 1.68 inches (43 mm).

Referring to FIG. 1, a wound golf ball of the present invention includes a center 1 having at least one layer, at least one intermediate layer 2 disposed over the center 1, a wound layer 3 disposed over the at least one intermediate layer 2, and a cover 4 disposed over the wound layer 3. The combination of the center 1 and each intermediate layer 2 (only one layer depicted) form the core of the golf ball. The cover 4 is shown as a single layer. The cover can have more than one layer, of course, such as in a two-layer cover construction (not shown) where the first cover layer surrounds the wound layer 3 and the second cover layer surrounds the first layer.

EXAMPLES

Certain embodiments of the present invention are illustrated by reference to the following examples:

Examples 1–2

Golf Ball Cores Before Winding Layer Applied

Golf ball cores, before the winding layer is applied, that combined solid, unitary rubber centers with an intermediate layer of either a thermoplastic ionomer resin or a thermoplastic resin were prepared according to the invention. The properties of the centers and cores, i.e., one intermediate layer disposed over the center, are listed in Table 1. The intermediate layer of each of Examples 1–2 was injection molded over each center. In these Examples, the ionomer thermoplastic material was a blend of SURLYN ionomers, and the thermoplastic material was a blend including FUSABOND 525D, also called SURLYN NMO 525D, with one or more SURLYN ionomers, all available from E.I. DuPont de Nemours & Co., of Wilmington, Del.

TABLE 1

| | Diameter (in.) | Atti Comp. | CoR (@ 125 ft/s) | Specific Gravity |
|---|---|---|---|---|
| Center Core | 1.39 | 68 | 0.791 | 1.14 |
| Example 1: With Ionomer Thermoplastic Intermediate Layer | 1.51 | 86 | 0.808 | 64 |
| Example 2: With Thermoplastic Intermediate Layer | 1.51 | 81 | 0.802 | 59 |

Examples 3–8

Multi-Layer Wound Golf Balls According to the Present Invention

The spin tests conducted on the golf balls of these examples, e.g., Standard Driver Spin, Average Driver Spin, 8-Iron Spin, and V2-Wedge Spin, were conducted under the conditions set forth in Table 2. In order to standardize such spin tests, the testing equipment for each club type was calibrated with a selected commercial ball to obtain a desired spin rate, as demonstrated for each test in Table 2. The Pinnacle Gold® and Tour Balata® golf balls used to calibrate the equipment are available from Acushnet Company of Fairhaven, Mass. These setup conditions were used for testing balls prepared according to the invention and for comparative testing for each club type listed in Tables 3 & 4.

TABLE 2

| Spin test | Calibration Ball | Launch angle | Ball speed | Spin Rate |
|---|---|---|---|---|
| Standard Driver | Pinnacle Gold ® | 9.5° | 160 mph | 3000 rpm |
| Average Driver | Pinnacle Gold ® | 10.5° | 140 mph | 3600 rpm |
| 8-iron | Tour Balatag ® | 18.5° | 115 mph | 9000 rpm |
| ½-Wedge | Tour Balatag ® | 32° | 52 mph | 7200 |

The multi-layer, wound golf balls of Examples 3–8 were prepared using the center of Examples 1–2. The intermediate layer in Examples 3–8 was chosen from a polymer including an ionomer thermoplastic resin or a thermoplastic resin, or a blend thereof, as noted in Table 3.

A wound layer was disposed on each of the cores. The windings for the golf balls of Examples 3–8 were made of a polyether urea thread, sold under the LYCRA series, available from E.I. DuPont de Nemours & Co., of Wilmington, Del. The cover was then disposed over the wound layer. For cover of an ionomeric or other thermoplastic material, the thickness of the thread layer for each ball was approximately 0.95 mm. For covers with a urethane thermoset layer, the thickness of the thread layer for each ball was approximately 0.995 mm. In all balls of Examples 3–8, the outer diameter of the core plus the wound layer, reflected as an average of at least four measurements, was around 1.585 inches (40 mm).

The single cover layer in these examples, as shown in Table 3, was selected from thermoplastic or thermosetting materials, or blends thereof. "Blends" in this application are frequently referred to as being thermoset or thermosetting if they include a thermoset material.

Advantageously, the golf balls of Examples 3–6, which contain thermoplastic and/or ionomer thermoplastic formulations in the cover layers, compare favorably to the conventional golf ball of Example 9. As can be seen from Tables 3 & 4, the golf balls according to the invention of Examples 3–6 show comparable standard driver spin, average driver spin, and V2-wedge spin to the conventional golf ball of Example 9, while offering a distinct improvement in 8-iron spin.

Also, the golf balls of Examples 3 and 6 show modest increases in spin for all clubs tested, compared to the conventional golf ball of Example 10. This phenomenon is of particular interest because the covers on all three balls are made from the same material.

Spin ratios of standard or average Driver spin to 8-iron or to Y7.-wedge spin can additionally provide comparison between the golf balls according to the invention and golf balls of different construction. For driver-to-iron or driver-to-wedge ratios, it is particularly desirable that the spin ratio be comparatively low, since lower spin is considered more desirable for a driver and higher spin is considered more desirable for irons and wedges. Several differences in driver-to-iron and driver-to-wedge spin ratios exist between the golf balls according to the invention and selected golf balls of different construction.

The golf balls according to the invention have lower, and thus more desirable, spin ratios of driver to wedge and iron spin rates than the conventional golf balls of Examples 9, 11, and 12, while the golf balls prepared according to the invention have similar compression, hardness, and other properties.

Further, in comparison to the golf balls according to the invention, i.e., Examples 3–8, the conventional golf balls of Examples 11 and 12 exhibit significantly higher, and thus less desirable, driver-to-wedge spin ratios. This can seen very clearly across the board by examining the standard driver spins and to a lesser extent when considering the average driver spin ratios.

Examples 9–12

Comparative Examples of Golf Balls Possessing a Different Construction than According to the Invention Examples 9–12 are conventional golf balls with different construction than the golf balls prepared according to the present invention. The properties of these balls are included for comparison and reference, as shown in Table 4.

Example 9 was a multi-layer golf ball with a polybutadiene core having a diameter of about 1.55 inches (39 nun). Disposed over the solid core was a thermoplastic inner cover layer, such that the diameter of the unfinished ball is about 1.62 inches (41 mm). An elastomeric urethane outer cover layer having a Shore D hardness of about 60 was disposed over the thermoplastic inner layer. Example 10 was also a multi-layer golf ball with a polybutadiene core having a diameter of about 1.43 inches (36 mm). Disposed over the solid core was a mantle layer composed of an Estane®/Hytrel® polymer blend, such that the diameter of the unfinished ball was about 1.55 inches (39 mm). A thermoplastic cover layer having a Shore D hardness of about 70 was disposed over the mantle layer. Example 11 was a wound golf ball with a liquid-filled Pebax© center having a diameter of about 1.13 inches (29 mm). A wound layer was disposed over the center, such that the diameter of the ball core was about 1.58 inches (40 mm). An elastomeric urethane cover layer was disposed over the wound core to form the golf ball of Example 11. Example 12 was also a wound golf ball, but with a liquid-filled rubber center having a diameter of about 1.125 inches (29 mm). A wound layer was disposed over the center such that the diameter of the ball core was about 1.6 inches (41 mm). A synthetic balata cover layer was disposed over the wound core to form the golf ball of Example 12.

It is to be understood that the invention is not to be limited to the exact configuration as illustrated and described herein. For example, it should be apparent that a variety of materials would be suitable for use in the composition or method of making the golf balls according to the Detailed Description of the Preferred Embodiments. Accordingly, all expedient modifications readily attainable by one of ordinary skill in the art from the disclosure set forth herein, or by routine experimentation therefrom, are deemed to be within the spirit and scope of the invention as defined by the appended claims.

TABLE 3

| Intermediate Layer/ Cover Layer | Atti Comp. | CoR (@ 125 ft/s) | Hardness (Shore D) | Std. Driver Spin (rpm) | Avg. Driver Spin (rpm) | 8-Iron Spin (rpm) | ½-Wedge Spin (rpm) |
|---|---|---|---|---|---|---|---|
| Example 3 Thermoplastic/ Thermoplastic ionomer | 104 | 0.798 | 66 | 3030 | 3780 | 7770 | 6290 |
| Example 4 Thermoplastic/ Thermoplastic | 100 | 0.791 | 62 | 3160 | 3860 | 7630 | 6640 |
| Example 5 Thermoplastic ionomer/ Thermoplastic | 103 | 0.789 | 62 | 3190 | 3910 | 7610 | 6630 |
| Example 6 Thermoplastic ionomer/ Thermoplastic ionomer | 108 | 0.793 | 66 | 3120 | 3860 | 7760 | 6230 |
| Example 7 Thermoplastic ionomer/ Thermoset urethane | 101 | 0.784 | 55 | 3370 | 4080 | 7850 | 6870 |
| Example 8 Thermoplastic/ Thermoset urethane | 98 | 0.786 | 55 | 3380 | 4060 | 7920 | 6820 |

TABLE 4

| Comparative Golf Balls | Atti. Comp | CoR (1@ 125 ft/s) | Hardness (Shore D) | Std. Driver Spin (rpm) | Avg. Driver Spin (rpm) | 8-Iron Spin Spin (rpm) | ½-Wedge Spin (rpm) |
|---|---|---|---|---|---|---|---|
| Example 9 solid center, thermoplastic/ thermoset inner/outer cover | 94 | 0.798 | 59 | 3150 | 3740 | 6920 | 6620 |
| Example 10 solid center, thermoplastic mantle & cover | 85 | 0.800 | 69 | 2940 | 3550 | 7310 | 5860 |
| Example 11 liquid center, wound ball, thermoset cover | 101 | 0.792 | 57 | 3880 | 4590 | 8230 | 7010 |
| Example 12 liquid center, wound ball, synthetic balata cover | 94 | 0.793 | 50 | 4190 | 4910 | 8690 | 7200 |

What is claimed is:

1. A multi-layer, wound golf ball comprising:

a solid center;

at least one solid intermediate layer disposed over the center;

a wound layer of a tensioned material disposed over the at least one intermediate layer; and a cover disposed over the wound layer, the cover comprising polyurea;

wherein the tensioned material comprises polyether urea.

2. The golf ball of claim 1, wherein the center comprises polybutadiene.

3. The golf ball of claim 1, wherein the center has a diameter from about 0.9 inches (23 mm) to 1.5 inches (38 mm).

4. The golf ball of claim 1, wherein the wound layer has a thickness from about 0.9 mm to 8 mm.

5. The golf ball of claim 1, wherein the wound layer has a thickness less than 1 mm.

6. The golf ball of claim 1, wherein the cover is a single layer.

7. A multi-layer, wound golf ball comprising:

a solid center;

at least one intermediate layer disposed over the center;

a wound layer of a tensioned material disposed over the at least one intermediate layer; and a cover disposed over the wound layer, the cover comprising polyurea;

wherein the tensioned material comprises polyether urea; and wherein the at least one intermediate layer comprises a thermoset material.

* * * * *